US011815319B2

(12) United States Patent
Chehade et al.

(10) Patent No.: US 11,815,319 B2
(45) Date of Patent: Nov. 14, 2023

(54) HEAT EXCHANGER SYSTEM HAVING A MESH PANEL

(71) Applicant: OVH, Roubaix (FR)

(72) Inventors: Ali Chehade, Moncheaux (FR); Mohamad Hnayno, Roubaix (FR); Louis Genelle, Wasquehal (FR)

(73) Assignee: OVH, Roubaix (FR)

( * ) Notice: Subject to any disclaimer, the term of this patent is extended or adjusted under 35 U.S.C. 154(b) by 65 days.

(21) Appl. No.: 17/677,185

(22) Filed: Feb. 22, 2022

(65) Prior Publication Data

US 2022/0279680 A1 Sep. 1, 2022

(30) Foreign Application Priority Data

Feb. 26, 2021 (EP) ..... 21305239

(51) Int. Cl.

| | |
|---|---|
| ***F28F 13/00*** | (2006.01) |
| ***F28C 1/14*** | (2006.01) |
| ***F28F 25/06*** | (2006.01) |
| ***F28F 27/00*** | (2006.01) |

(52) U.S. Cl.

CPC ..... *F28F 13/003* (2013.01); *F28C 1/14* (2013.01); *F28F 25/06* (2013.01); *F28F 27/003* (2013.01)

(58) Field of Classification Search

CPC . F28C 1/14; F28F 13/003; F28F 25/06; F28F 25/08; F28F 27/003

See application file for complete search history.

(56) References Cited

U.S. PATENT DOCUMENTS

| | | | |
|---|---|---|---|
| 3,108,451 | A | 10/1963 | Clifford |
| 3,432,357 | A | 3/1969 | Dankese |
| 3,984,995 | A | 10/1976 | Starr et al. |
| 5,349,829 | A | 9/1994 | Tsimerman |
| 7,186,084 | B2 | 3/2007 | Bunker et al. |

(Continued)

FOREIGN PATENT DOCUMENTS

| | | | |
|---|---|---|---|
| DE | 3839372 | A1 * | 5/1990 |
| DE | 3839372 | A1 | 5/1990 |

(Continued)

OTHER PUBLICATIONS

Machine Translation of DE-3839372-A1; retrieved Jun. 16, 2023 (Year: 2023).*

(Continued)

*Primary Examiner* — Len Tran
*Assistant Examiner* — Hans R Weiland
(74) *Attorney, Agent, or Firm* — BCF LLP

(57) ABSTRACT

A mesh panel for a heat exchanger system is provided. The mesh panel comprises a mesh body extending from an upper end to a lower end, the mesh body having an inlet side and an outlet side opposite the inlet side. The mesh body comprises a plurality of mesh wires arranged to form a mesh pattern defining a plurality of mesh openings between the mesh wires, and at least one penetrating mesh portion extending at least partly along a depth direction of the mesh body, the depth direction being normal to a plane extending between the upper and lower ends of the mesh body, the at least one penetrating mesh portion at least partly defining an air flow opening, the air flow opening having greater dimensions than each of the mesh openings.

20 Claims, 12 Drawing Sheets

(56) References Cited

U.S. PATENT DOCUMENTS

| | | | | |
|---|---|---|---|---|
| 7,485,234 | B2 | 2/2009 | Max | |
| 10,788,268 | B2 * | 9/2020 | Byrne | F28F 25/04 |
| 10,845,068 | B2 | 11/2020 | Mullen et al. | |
| 2004/0251009 | A1 | 12/2004 | Andersson et al. | |
| 2018/0231264 | A1 * | 8/2018 | Vadder | F28F 27/00 |
| 2018/0283814 | A1 * | 10/2018 | Najafifard | F28B 1/06 |

FOREIGN PATENT DOCUMENTS

| | | | |
|---|---|---|---|
| EP | 1698847 | A1 | 9/2006 |
| GB | 2378501 | A | 2/2003 |
| WO | 2018/033722 | A1 | 2/2018 |
| WO | 2019194767 | A2 | 10/2019 |

OTHER PUBLICATIONS

Technical Info, EcoMESH, https://www.ecomesh.com/technical-info/ accessed on Feb. 15, 2022, pdf 2 pages.
India Mart, https://www.indiamart.com/proddetail/dimple-perforated-sheets-4241183562.html accessed on Feb. 15, 2022, pdf 3 pages.
Adiabatic Cooling, Trane Care Services, https://www.tranebelgium.com/files/sav-doc/12/en/12.isxfxj8k.pdf accessed on Feb. 15, 2022, pdf 4 pages.
Extended European Search Report with regard to the counterpart EP Patent Application No. 21305239.2 completed Aug. 11, 2021.
English Abstract for DE3839372 retrieved on Espacenet on Feb. 15, 2022.

* cited by examiner

HEAT EXCHANGER SYSTEM HAVING A MESH PANEL

CROSS REFERENCE

The present application claims priority from European Patent Application No. EP 21305239.2, filed on Feb. 26, 2021, the entirety of which is incorporated by reference herein.

FIELD OF TECHNOLOGY

The present technology relates to heat exchanger systems, such as dry coolers, using mesh panels for adiabatic cooling.

BACKGROUND

Dry coolers and similar heat exchanger systems reject thermal energy from a heat transfer fluid (e.g., water) circulating therethrough to the atmosphere. For example, in a data center, a dry cooler can be used to cool heated water extracted from within the data center (e.g., water circulated through water blocks to collect heat from heat-generating components). In order to improve the efficiency of dry coolers, in some cases, adiabatic cooling can be implemented in order to lower the temperature of (i.e., pre-cool) ambient air that flows through the dry cooler. For example, in some cases, a water spraying system (i.e., an atomizer) is placed at the air inlet of the dry cooler to spray water and thereby increase humidity of the ambient air and thereby reduce its temperature. Other adiabatic cooling solutions are also available, including for instance evaporative cooling pads, or mesh panels on which water is applied and through which ambient air flows prior to entering the dry cooler.

However, these solutions may also have various disadvantages. For instance, spraying water under high pressure which advantageously promotes water evaporation (due to the small size droplets released) can require a complex and expensive pumping system. Moreover, in some cases, high pressure water spraying can be hazardous since, if the water is contaminated, it may promote dispersion of pathogenic bacteria such as *Legionella*. As a result, this practice is forbidden in some countries. Conversely, spraying water under low pressure (e.g., below 5 bars) does not require a complex pumping system, but it can be wasteful in terms of its usage of water and not very efficient as evaporation of the sprayed water is not achieved as easily. For their part, evaporative cooling pads can obstruct flow of ambient air therethrough which can result in greater power consumption and noise emission by the dry cooler. Mesh panels, which allow using low pressure water spraying, improve homogenization of the evaporation of water but can still be wasteful in water usage and limited in terms of the ratio of water evaporation achieved.

There is therefore a desire for a heat exchanger system which can alleviate at least some of these drawbacks.

SUMMARY

It is an object of the present technology to ameliorate at least some of the inconveniences present in the prior art.

According to one aspect of the present technology, there is provided a mesh panel for a heat exchanger system, the mesh panel comprising: a mesh body extending from an upper end to a lower end, the mesh body having an inlet side and an outlet side opposite the inlet side, the mesh body comprising a plurality of mesh wires arranged to form a mesh pattern defining a plurality of mesh openings between the mesh wires, the mesh body comprising: at least one penetrating mesh portion extending at least partly along a depth direction of the mesh body, the depth direction being normal to a plane extending between the upper and lower ends of the mesh body, the at least one penetrating mesh portion at least partly defining an air flow opening, the air flow opening having greater dimensions than each of the mesh openings.

In some embodiments, the at least one penetrating mesh portion comprises: an inlet end; an outlet end distanced from the inlet end along the depth direction, the outlet end defining the air flow opening; and a peripheral side wall extending between the inlet end and the outlet end.

In some embodiments, the peripheral side wall of the at least one penetrating mesh portion converges toward the outlet end.

In some embodiments, the at least one penetrating mesh portion has a generally truncated conical shape.

In some embodiments, the air flow opening defined by each of the at least one penetrating mesh portion is circular.

In some embodiments, the air flow opening defined by each of the at least one penetrating mesh portion is polygonal.

In some embodiments, the at least one penetrating mesh portion defines a first perimeter at the inlet end and a second perimeter at the outlet end; and the first perimeter is greater than the second perimeter.

In some embodiments, the at least one penetrating mesh portion comprises a plurality of penetrating mesh portions; and at least some of the penetrating mesh portions are spaced apart from one another along a height direction of the mesh body, the height direction being normal to the depth direction.

In some embodiments, the at least one penetrating mesh portion deflects air flowing through the air flow opening to cause turbulence thereof.

In some embodiments, the mesh body comprises a plurality of mesh layers stacked with one another in the depth direction to form the mesh body; and the air flow opening defined at least in part by the at least one penetrating mesh portion is defined in part by each of the mesh layers.

In some embodiments, the mesh body has a first angled portion extending from the upper end and a second angled portion extending from the lower end to the first angled portion, the first and second angled portions being angled relative to one another; each of the at least one penetrating mesh portion is formed in one of the first angled portion and the second angled portion.

In some embodiments, the mesh body has an undulating configuration such that the mesh body forms a plurality of undulations offset from another in a height direction of the mesh body, the height direction being normal to the depth direction.

According to another aspect of the present technology, there is provided a heat exchanger system comprising: a frame; at least one heat exchanger panel connected to the frame and configured to exchange heat with air flowing therethrough, the at least one heat exchanger panel having an inlet side and an outlet side, the at least one heat exchanger panel comprising: a cooling coil for circulating fluid therein; and a plurality of fins in thermal contact with the cooling coil, the fins being spaced from one another for air to flow therebetween and into an interior space of the heat exchanger system; a fan assembly connected to the frame and comprising at least one fan, the at least one fan being rotatable about a fan rotation axis to pull air into the interior space through the at least one heat exchanger panel and evacuate heated air from the interior space through the fan assembly; the mesh panel of any one of claims 1 to 9, the mesh panel being disposed on the inlet side of the at least one heat exchanger panel such that rotation of the at least one fan causes ambient air to flow subsequently through the mesh panel, through the heat exchanger panel and into the interior space; and a water distribution system operable to spray water on the mesh panel to pre-cool ambient air flowing through the mesh panel.

In some embodiments, the water distribution system comprises a conduit disposed between the at least one heat exchanger panel and the mesh panel, the water distribution system being operable to spray water from the conduit onto the mesh panel.

In some embodiments, the heat exchanger system is a dry cooler.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

The drawings are not to scale unless otherwise specified.

DETAILED DESCRIPTION

Figure 1:
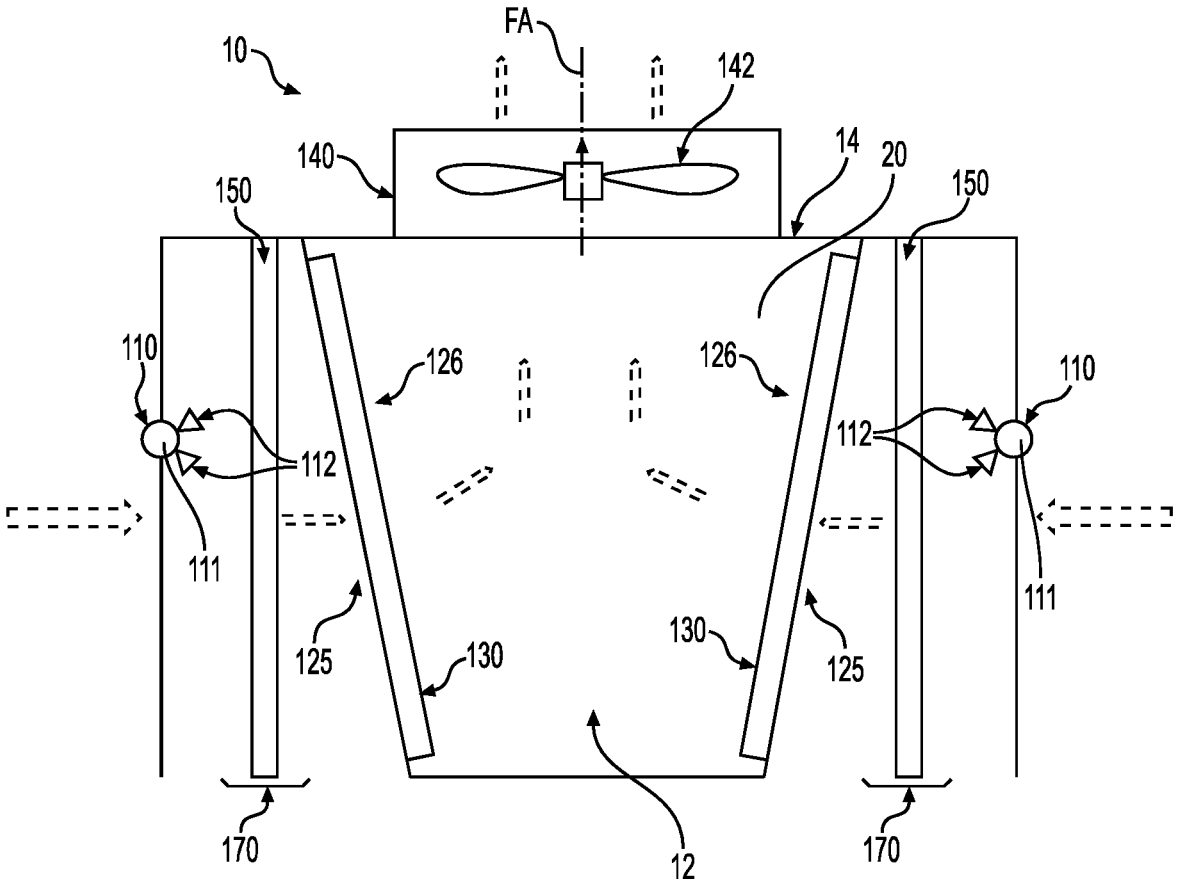
FIG. 1 is a right side elevation view of a dry cooler according to an embodiment of the present technology.

FIG. 1 illustrates a heat exchanger system 10 in accordance with an embodiment of the present technology. In this embodiment, the heat exchanger system 10 is a dry cooler. However, it is contemplated that the heat exchanger system 10 may be any other suitable type of heat exchanger system in other embodiments (e.g., a chiller). As will be described in greater detail below, the dry cooler 10 is provided with an adiabatic cooling system for pre-cooling ambient air flowing into an interior space of the dry cooler 10 and thereby increase efficiency of the dry cooler 10. Notably, the adiabatic cooling system comprises mesh panels 150 which promote evaporation of water into the air flowing therethrough in order to reduce the air flow's temperature.

As shown in FIG. 1, the dry cooler 10 includes a frame 14 for supporting components of the dry cooler 10. The frame 14 may be anchored to a support surface (e.g. a ground surface) by fasteners. The support surface may be any suitable support surface. For instance, in this embodiment, the support surface is a surface surrounding a building or a roof of a building (e.g., a building housing a data center). However, in other embodiments, the support surface could be part of a structure purposefully built to support the frame 14.

Figure 2:
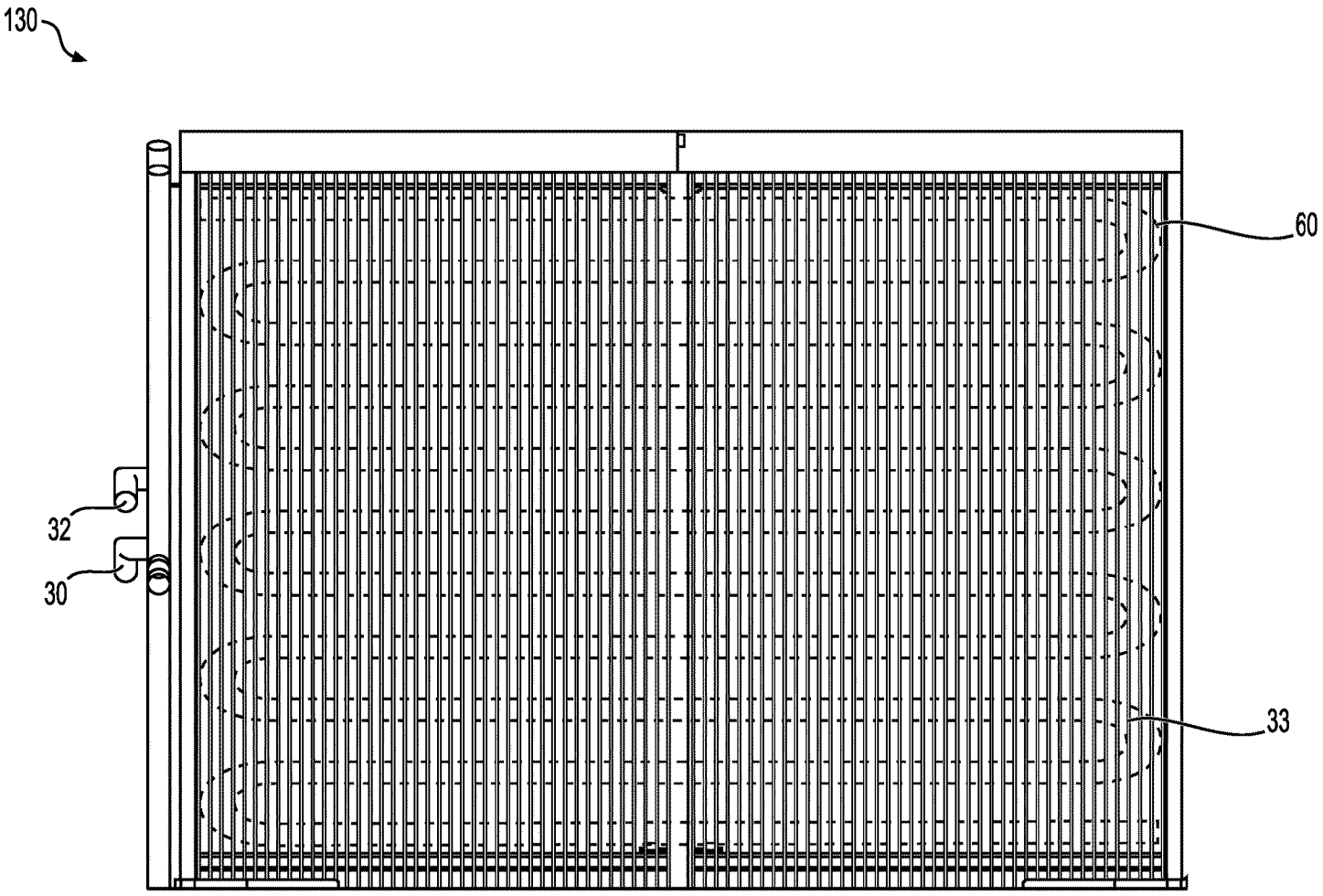
FIG. 2 is a front elevation view of a heat exchanger panel of the dry cooler of FIG. 1.

The dry cooler 10 comprises two heat exchanger panels 130 connected to the frame 14 and configured to exchange heat with air flowing therethrough. In particular, the heat exchanger panels 130 are liquid-to-air heat exchanger panels 130 that transfer heat from the fluid (e.g., water) circulating therein to the air flowing therethrough. As shown in FIG. 1, each heat exchanger panel 130 has an inlet side 125 and an outlet side 126 through which, in use, air enters and exists the heat exchanger panel 130 respectively. As shown in FIG. 2, each heat exchanger panel 130 has a cooling coil 60 for circulating fluid therein and a plurality of fins 33 in thermal contact with the cooling coil 60. The cooling coil 60 has an inlet 30 and an outlet 32 for feeding fluid into and discharging fluid from the cooling coil 60. The fins 33 are spaced from one another for air to flow therebetween, from the inlet side 125 to the outlet side 126, into an interior space 12 of the dry cooler 10.

In this embodiment, the heat exchanger panels 130 are in an inclined position defining a V-shaped configuration of the heat exchanger panels 130. Notably, an axis of each heat exchanger panel 130, extending from the upper end to the lower end of the heat exchanger panel 130, is angled relative to a vertical axis. The heat exchanger panels 130 could be oriented differently in other embodiments. For instance, the heat exchanger panels 130 may be disposed to extend vertically and thereby have an I-shaped configuration.

As shown in FIG. 1, enclosing panels 20 (one of which is shown in FIG. 1) are disposed at opposite longitudinal ends of the dry cooler 10 and connected to the frame 14. The enclosing panels 20 enclose in part the interior space 12 of the dry cooler 10.

The dry cooler 10 comprises a fan assembly 140 connected to the frame 14 and configured to cause air flow through the dry cooler 10. In particular, the fan assembly 140 comprises a plurality of fans 142 (one of which is shown in FIG. 1) located at an upper end of the dry cooler 10. In this embodiment, the fans 142 are rotatable about respective vertical axes FA. Together, the heat exchanger panels 130, the fan assembly 140 and the enclosing panels 20 define the interior space 12 of the dry cooler 10. The fan assembly 140 includes respective motors (not shown) operatively connected to each of the fans 142 to cause rotation of the fans 142 about the axes FA. Thus, as denoted by the air flow arrows in FIG. 1, the fan assembly 140 pulls ambient air from lateral sides of the dry cooler 10, through the heat exchanger panels 130 into the interior space 12, and rejects the resulting heated air through the fan assembly 140 out into the atmosphere vertically above the dry cooler 10.

The dry cooler 10 thus functions by pumping heated water (e.g., extracted from a data center in this example) through the cooling coils 60 of the heat exchange panels 130, while simultaneously pulling ambient air between the fins 33 of the heat exchange panels 130. The ambient air absorbs heat from the heated water circulating through the cooling coils 60. As ambient air is pulled in through the heat exchange panels 130 into the interior space 12 of the dry cooler 10, thermal energy is transferred from the water circulating in the heat exchanger panels 130 to the ambient air. The now-heated air is then discharged from the interior space 12 of the dry cooler 10 through the fan assembly 140. The water circulating in the heat exchanger panels 130 is thus cooled and is recirculated back into the data center.

While in this embodiment the heat transfer fluid is water, in other embodiments, the heat transfer fluid may be a dielectric fluid, a refrigerant fluid, a phase change material (PCM) or any other fluid suitable for collecting and discharging thermal energy.

It will be appreciated that the configuration of the dry cooler 10 as described above is provided merely as an example to aid in understanding the present technology. The dry cooler 10 may be configured differently in other embodiments. For instance, in other embodiments, a single heat exchanger panel 130 may be provided, and the fan assembly 140 may include a single fan 142. Moreover, the fans 142 may be oriented such that their respective fan rotation axes FA extend horizontally, or at angle between horizontal and vertical.

The adiabatic cooling system of the dry cooler 10 will now be described in greater detail. In this embodiment, as shown in FIG. 1, the adiabatic cooling system includes two mesh panels 150 and a water distribution system 110 for spraying water on the mesh panels 150.

The water distribution system 110 is configured to spray water in a surrounding environment of the dry cooler 10, notably, in this embodiment, onto the mesh panels 150 such that ambient air flows through the sprayed water retained by the mesh panels 150. In this embodiment, the water distribution system 110 includes, for each heat exchanger panel 130, a conduit 111 for circulating water therein and a plurality of nozzles 112 for spraying water droplets from the conduit 111 onto the corresponding mesh panel 150. In this embodiment, the water distribution system 110 also includes a pump (not shown) for pumping water through the water distribution system 110. In other embodiments, the pump may be omitted (e.g., the water distribution system may be connected to municipal makeup water operating on low pressure—e.g., 3-4 bars). As can be seen in FIG. 1, in this embodiment, each conduit 111 is disposed on an external side of the mesh panels 150. The conduit 111 may be disposed between one of the heat exchanger panels 130 and the corresponding mesh panel 150 in other embodiments (see FIG. 8).

In this embodiment, the water distribution system 110 operates on low pressure. In the present disclosure, a system operating on low pressure is defined as operating at a pressure below 5 bars. In this embodiment, the water distribution system 110 operates at a pressure of approximately 1.5 bars. Since the water distribution 110 operates on low pressure, the pump thereof is relatively inexpensive. Moreover, spraying water at low pressure reduces the likelihood of causing the dispersion of pathogenic organisms. As such, the water distribution system 110 is compliant with regulations in jurisdictions in which high pressure water spraying is not permitted.

While in some embodiments the water distribution system 110 may continuously spray water onto the mesh panels 150, this may be wasteful and therefore not preferable. Instead, in this embodiment, the water distribution system 110 includes an electronic controller (not shown) which is in communication with the pump of the water distribution system 110 and with one or more valves to control the spray of water from the nozzles 112. The controller may control the spraying of water by the nozzles 112 based on a set timer (e.g., every 5 minutes). In other embodiments, the controller of the water distribution system 110 may be in communication with sensors (not depicted) such as a temperature sensor and/or a humidity sensor, such that the water distribution system 110 is activated and sprays water droplets only under specific environmental parameters. More precisely, the water distribution system 110 may be configured to spray water droplets only when the temperature and/or the humidity in a vicinity of the dry cooler 10 are above or below specific respective thresholds. Other environmental parameters may be contemplated in alternative embodiments. Alternatively or additionally, the controller of the water distribution system 110 may be in communication with sensors (not depicted) configured to sense a temperature of the water in the water distribution system 110 (e.g. before being sprayed on the mesh panels 150), water received in the drain 170, heat transfer fluid flowing in the heat exchanger panels 130 (e.g. at the inlet 30 and/or the outlet 32) such that the water distribution system 110 is activated and sprays water droplets only under specific operational conditions With reference to FIG. 1, the mesh panels 150 are disposed on either lateral side of the dry cooler 10. In some embodiments, a gutter or drain 170 is positioned beneath each mesh panel 150 to collect water that is not evaporated and that is streaming down the mesh panels 150. Water collected in the drain 170 is filtered and treated to eliminate bacteria and recirculated back into the water distribution system 110.

Figure 3:
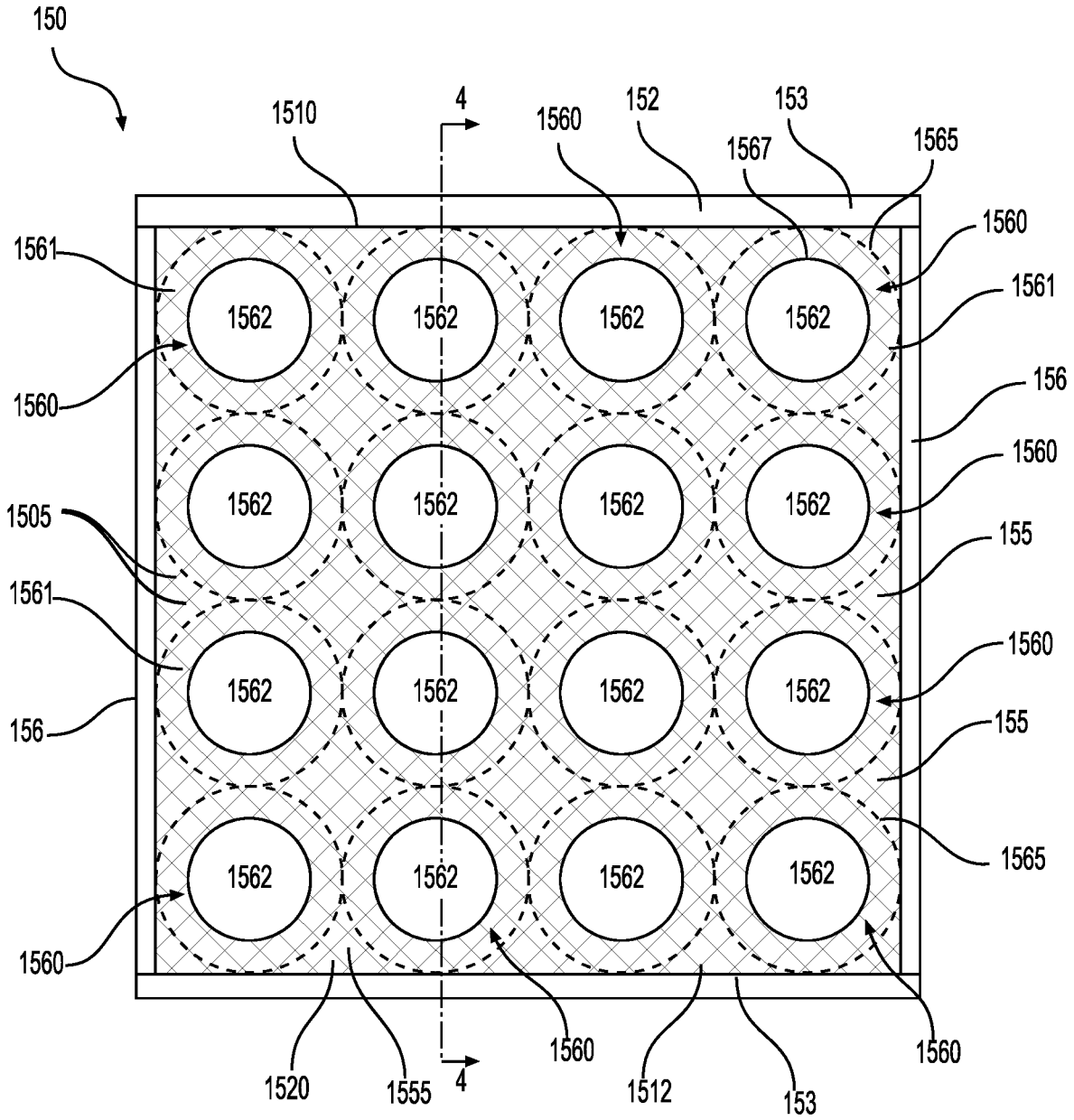
FIG. 3 is a front elevation view of a mesh panel of the dry cooler of FIG. 1.

In this embodiment, each of the mesh panels 150 has an identical configuration and therefore only one of the mesh panels 150 will be described in detail herein. It is to be understood that the same description applies to both mesh panels 150. With reference to FIG. 3, the mesh panel 150 has a mesh body 155 connected to a mesh panel frame 152 to support the mesh body 155. In this embodiment, as shown in FIG. 1, the mesh panel 150 is connected to the frame 14 of the dry cooler 10 by securing the mesh panel frame 152 to the frame 14. The mesh panel 150 may be secured in place in any other suitable way in other embodiments. Moreover, in this embodiment, the mesh panel frame 152 is generally rectangular and includes upper and lower frame members 153 and left and right frame members 156 interconnected to one another. The mesh panel frame 152 may be configured differently in other embodiments. For instance, in some embodiments, one or more of the frame members 153, 156 may be omitted.

The mesh body 155 has an air inlet side $\mathbf{1500}_A$ and an air outlet side $\mathbf{1500}_B$ opposite the air inlet side $\mathbf{1500}_A$. The mesh panel 150 is positioned such that in use, ambient air flows through the mesh body 155 from the air inlet side $\mathbf{1500}_A$ to the air outlet side $\mathbf{1500}_B$. A thickness of the mesh body 155 is measured between the air inlet side $\mathbf{1500}_A$ and the air outlet side $\mathbf{1500}_B$. As shown in FIG. 3, the mesh body 155 has a plurality of mesh wires 1505 arranged to form a mesh pattern such that the mesh wires 1505 define mesh openings 1520 therebetween. The mesh pattern may be configured differently in various embodiments. For instance, in this embodiment, the mesh openings 1520 defined by the mesh pattern are generally square openings. However, in other embodiments, the mesh openings 1520 may be shaped differently (e.g., hexagonal mesh openings).

In this embodiment, the mesh wires 1505 are made of plastic material but other materials are also contemplated.

As shown in FIG. 3, in this embodiment, the mesh body 155 has a planar portion 1555 that extends along a plane, and a plurality of penetrating mesh portions 1560, formed by the mesh wires 1505, that extend from the planar portion 1555. As will be explained in more detail below, the penetrating mesh portions 1560 are configured to increase contact between air flowing through the mesh panel 150 and the water sprayed on the mesh panel 150. In this embodiment, the penetrating mesh portions 1560 extend from the air inlet side $1500_A$ toward the air outlet side $1500_B$ at least partly along a depth direction of the mesh body 155. The depth direction is normal to a plane extending between the upper and lower ends 1510, 1512 of the mesh body 155.

Figure 4:
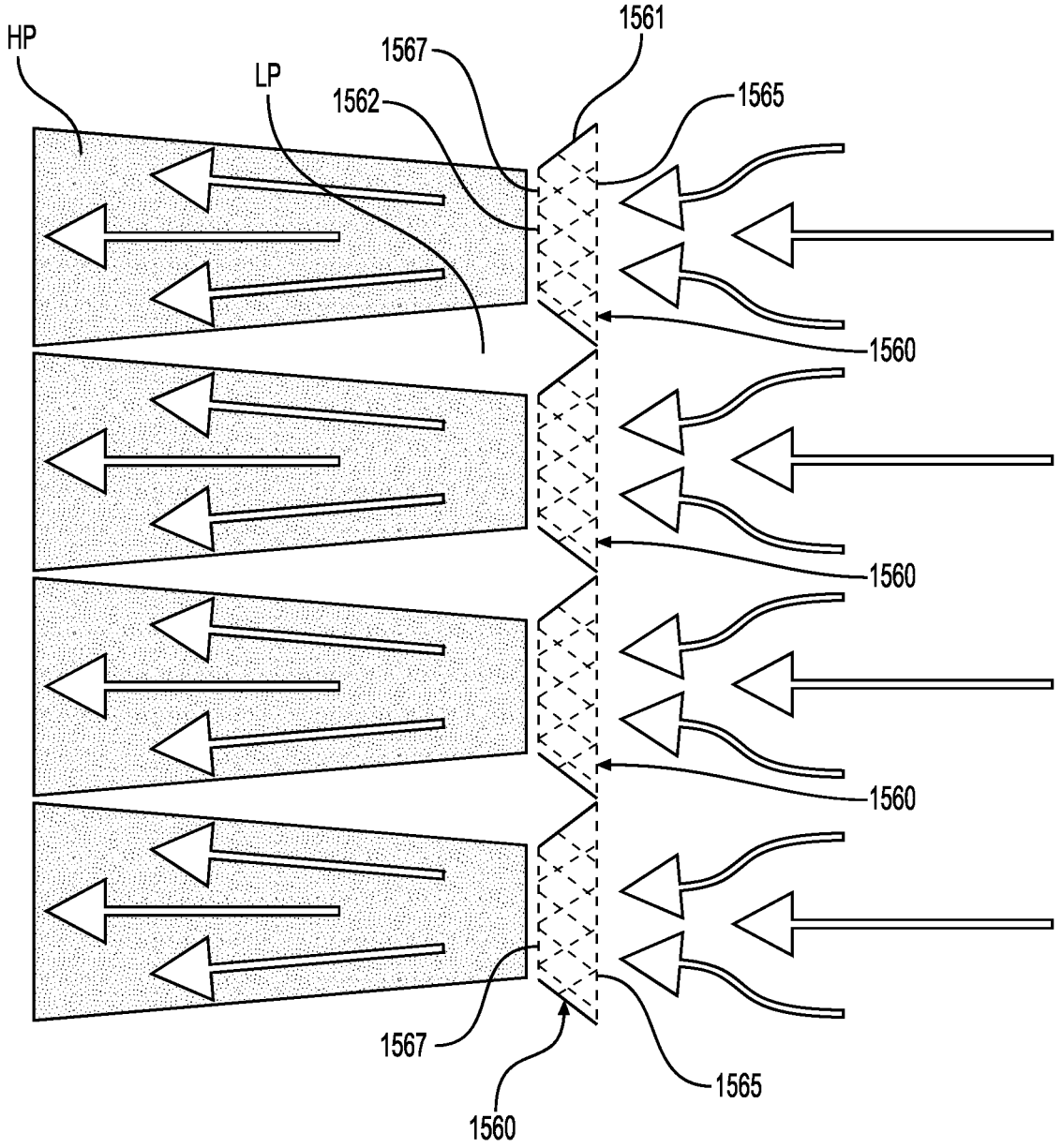
FIG. 4 is cross-sectional view of a mesh body of the mesh panel of FIG. 3 taken along line 4-4 in FIG. 3.

In this embodiment, the penetrating mesh portions 1560 of the mesh body 155 are all configured identically and therefore only one of the penetrating mesh portions 1560 will be described in detail herein. It is to be understood that the same description applies to the other penetrating mesh portions 1560. As best shown in FIG. 4, the penetrating mesh portion 1560 has a side wall 1561 that extends at least partly in the depth direction of the mesh body 155 and that deflects air flowing therethrough. In particular, the penetrating mesh portion 1560 has an inlet end 1565 disposed on the inlet side $1500_A$, and an outlet end 1567 disposed on the outlet side $1500_B$, and the side wall 1561 extends between the inlet end 1565 and the outlet end 1567. A depth of the penetrating mesh portion 1560 is measured between its inlet end 1565 and its outlet end 1567. For instance, in this embodiment, the depth of the penetrating mesh portion 1560 may be up to 30 cm. The penetrating mesh portion 1560 may have any other suitable depth in other embodiments.

Figure 5:
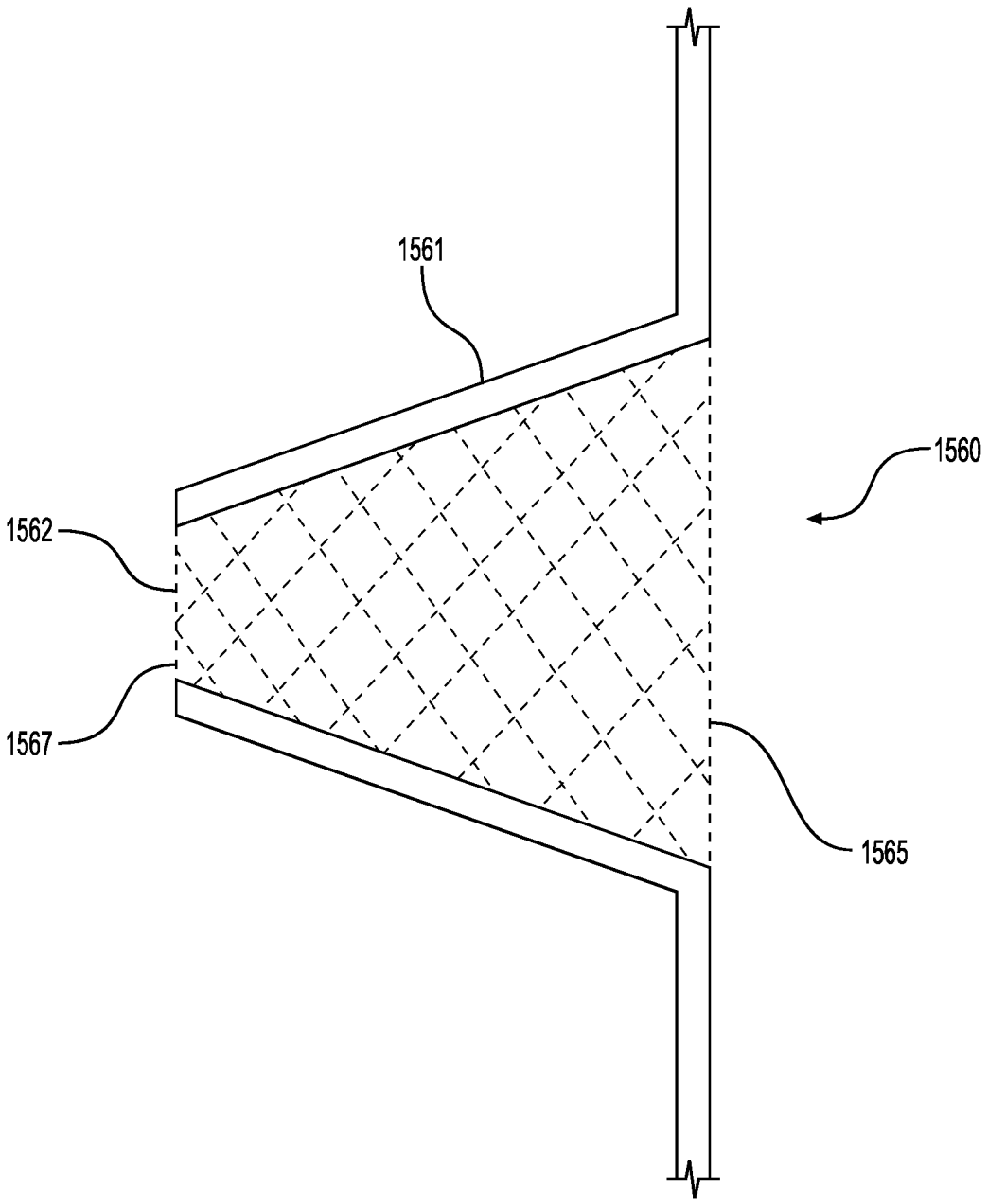
FIG. 5 is a cross-sectional view of penetrating mesh portion of the mesh panel of FIG. 3.

With reference to FIG. 5, in this embodiment, the side wall 1561 is a peripheral side wall in that it defines a periphery of the penetrating mesh portion 1560. As can be seen, in this embodiment, the peripheral side wall 1561 (and thus the penetrating mesh portion 1560) converges from the inlet end 1565 toward the outlet end 1567. That is, the dimensions of the peripheral side wall 1561 decrease from the inlet end 1565 to the outlet end 1567. For instance, a ratio of a diameter of the penetrating mesh portion 1560 at the inlet end 1565 over a diameter of the penetrating mesh portion 1567 at the outlet end 1567 may be between 1.1 and 10 and may be even greater. In this embodiment, the penetrating mesh portion 1560 has a generally truncated conical shape. As will be described in more detail below, it is contemplated that the penetrating mesh portion 1560 could have other shapes in other embodiments.

Figure 6A:
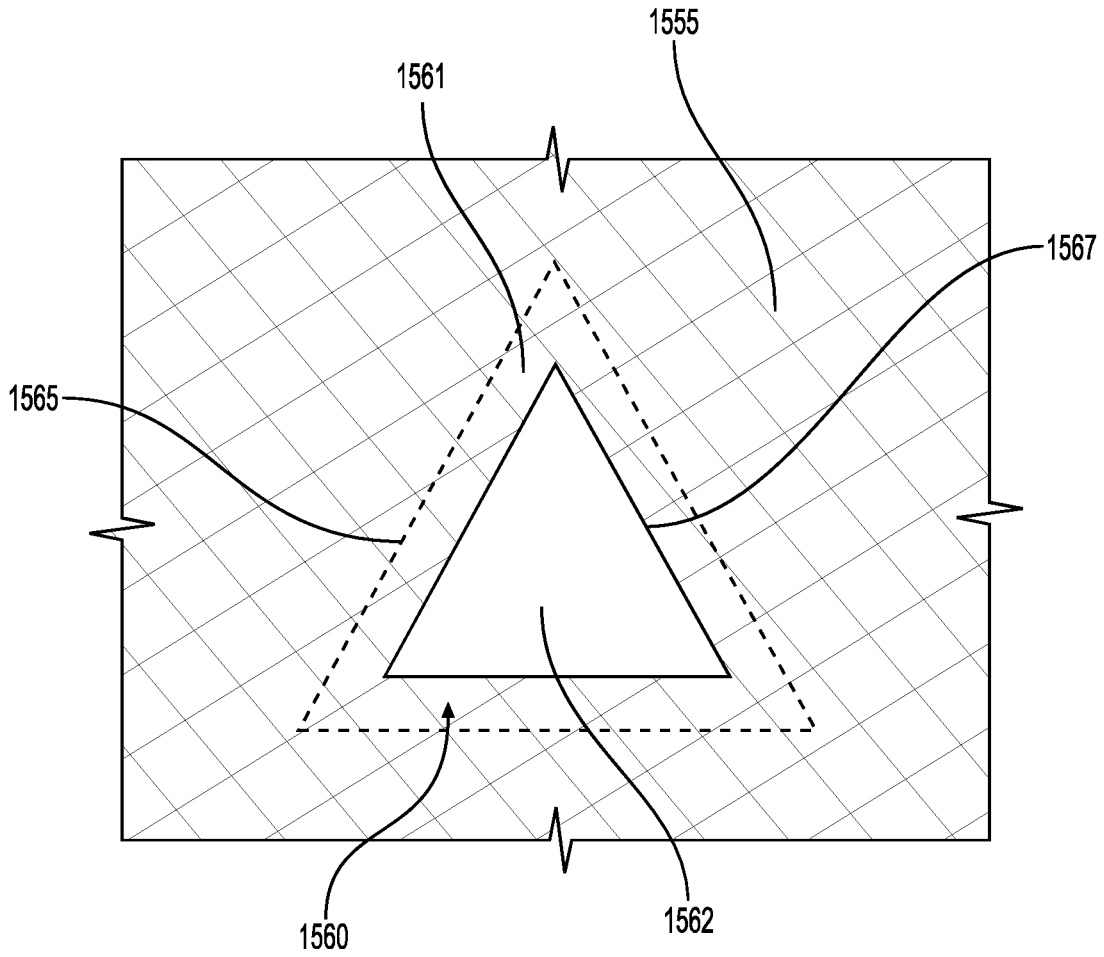
FIG. 6A is a front elevation view of part of a penetrating mesh portion according to an alternative embodiment.
Figure 6B:
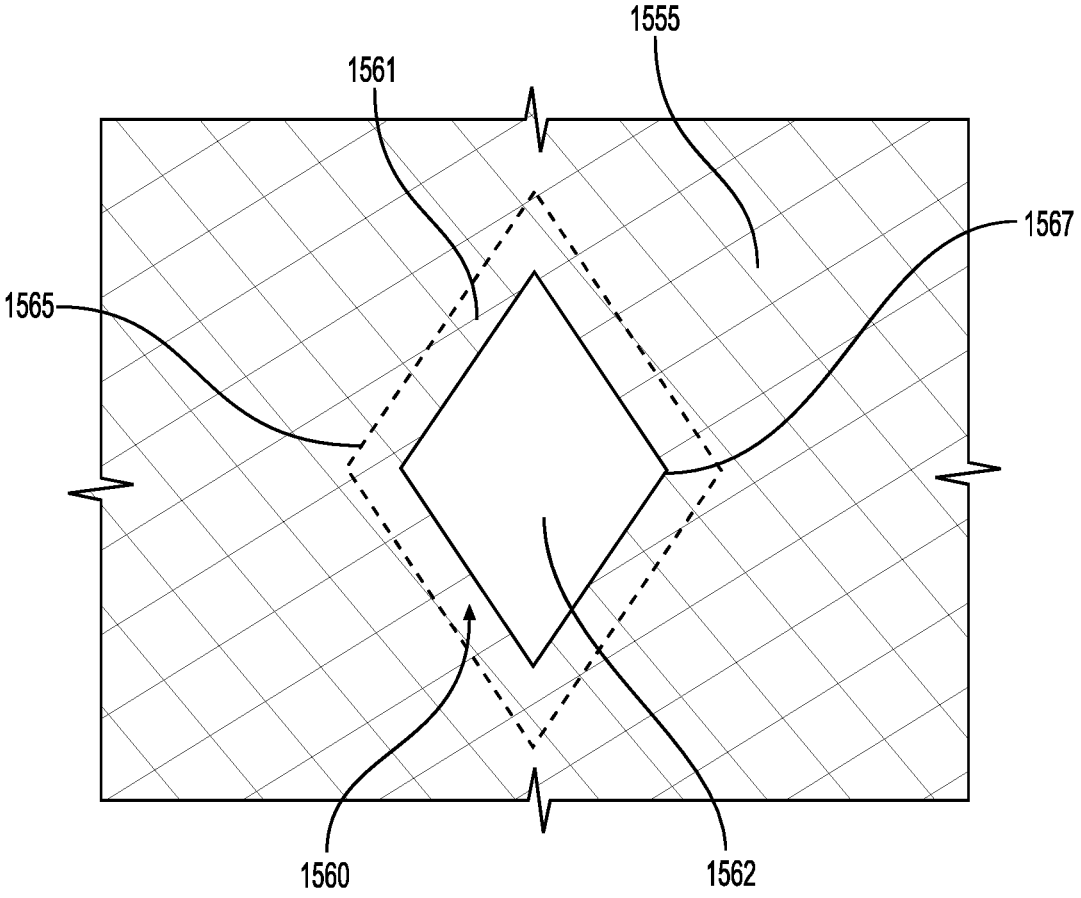
FIG. 6B is a front elevation view of part of a penetrating mesh portion according to another alternative embodiment.

As best shown in FIG. 3, the penetrating mesh portion 1560 defines an air flow opening 1562 through the mesh body 155. The air flow opening 1562 provides a part of the mesh body 155 that is not obstructed by the mesh pattern which allows a trajectory of water droplets sprayed by the water distribution system 110 to be uninterrupted by the mesh pattern at the penetrating mesh portion 1560. Notably, it is to be understood that the air flow opening 1562 is not akin to the mesh openings 1520 in that the air flow opening 1562 is a discontinuity in the mesh pattern of the mesh body 155. For instance, the air flow opening 1562 has greater dimensions than each of the mesh openings 1520. In this embodiment, the air flow opening 1562 is generally circular and a circumference thereof is greater than a periphery of one of the mesh openings 1520. While in this embodiment the air flow openings 1562 are circular, various other shapes are contemplated in other embodiments. For instance, with reference to FIGS. 6A and 6B, the air flow openings 1562 defined by the penetrating mesh portions 1560 may be triangular (FIG. 6A), or polygonal (e.g., quadrilateral as shown FIG. 6B, hexagonal, or octagonal).

In this embodiment, the configuration of the penetrating mesh portions 1560 provides a relatively uniform air flow at the outlet side $1500_B$ of the mesh body 155. Notably, as denoted by the air flow arrows in FIG. 4, as air flows through the mesh body 155, the converging penetrating mesh portions 1560 deflect air flow toward their respective air flow openings 1562. As can be seen, air exits the air flow openings 1562 along conical air flow paths expanding in a direction away from the mesh panel 150 (and towards the corresponding heat exchanger panel 130). The air flow reaching the heat exchanger panel 130 is thus generally more uniform than if a conventional mesh panel with no penetrating mesh portions 1560 were provided. Furthermore, as shown in FIG. 4, the conical air flow paths define high-pressure areas HP while low-pressure areas LP are formed in between the conical air flow paths as the air flowing through the planar portion 1555 of the mesh body 155 (i.e., in between the penetrating mesh portions 1560) are subject to some pressure loss caused by the mesh wires 1505. In particular, the penetrating mesh portions 1560 cause an increase of a speed of the air in the conical air flow paths, thereby defining the high-pressure areas HP. The increased air flow speed promotes convection and friction of the air with water droplets sprayed by the water distribution system 110, which causes the water droplets to split and thus facilitates water evaporation. In other words, spraying water droplets across the high-pressure areas HP splits the water droplets, thereby obtaining small-sized water droplets (i.e., smaller than is typically obtained on a low pressure spraying system) without having to operate the water distribution system 110 on high pressure. Reducing the size of the water droplets around and on the mesh panels 150 increases a thermal exchange surface between ambient air and the water droplets and also increases an evaporation ratio of the sprayed water, thereby increasing the cooling effect on the ambient air prior to its entry into the heat exchanger panels 130.

Moreover, the penetrating mesh portions 1560 can cause turbulent air flow as air exits the air flow openings 1562. The turbulence generated by the penetrating mesh portions 1560 may be adjusted by calibration of the shape of the penetrating mesh portions 1560, namely calibrating a shape of the side wall 1561, and a size of the air flow opening 1562. The turbulent air flow caused by the air flow openings 1562 can force air to follow a path that lingers along the mesh panel 150 (e.g., air vortices formed around the side walls 1561) before flowing through the heat exchanger panel 130, thereby increasing a time during which the air collects water. In doing so, the penetrating mesh portions 1560 enhance a cooling of air flowing therethrough.

The penetrating mesh portions 1560 may be formed in various ways. In this embodiment, the penetrating mesh portions 1560 are made by cutting the air flow openings 1562 into a mesh body and then punching the peripheral side walls 1561 of the penetrating mesh portions 1560 into the mesh body 155 around the air flow openings 1562. The penetrating mesh portions 1560 may be made differently in other embodiments. For instance, the mesh body 155 comprising the penetrating mesh portions 1560 may be fabricated using known plastic molding techniques or 3D-printing techniques.

With reference to FIG. 3, in this embodiment, the penetrating mesh portions 1560 are separated from adjacent penetrating mesh portions 1560 by a uniform distance. In particular, the penetrating mesh portions 1560 are generally distributed evenly along the mesh body 155. For instance, in this example, the penetrating mesh portions 1560 are distributed in a rectangular array with equal distances between adjacent penetrating mesh portions 1560. This even distribution of the penetrating mesh portions 1560 may contribute to homogenizing the effect of the penetrating mesh portions 1560 on the air flowing through the mesh body 155. The penetrating mesh portions 1560 may be arranged differently in other embodiments. For instance, the penetrating mesh portions 1560 may be unevenly distributed in an inhomogeneous manner on the mesh body 155.

The penetrating mesh portions 1560 may be configured differently in other embodiments. For instance, in some embodiments, rather than the penetrating mesh portions 1560 converging toward the outlet end 1567, in some embodiments, the peripheral side walls 1561 of the penetrating mesh portions 1560 may be cylindrical (i.e., same diameter at the inlet end 1565 and the outlet end 1567). Notably, in such embodiments, the extension of the side wall 1561 in the depth direction increases the surface contact between the incoming air flow and the water retained on the side wall 1561, thereby increasing evaporation of water to cool the ambient air flowing through the mesh panel 150.

Figure 7A:
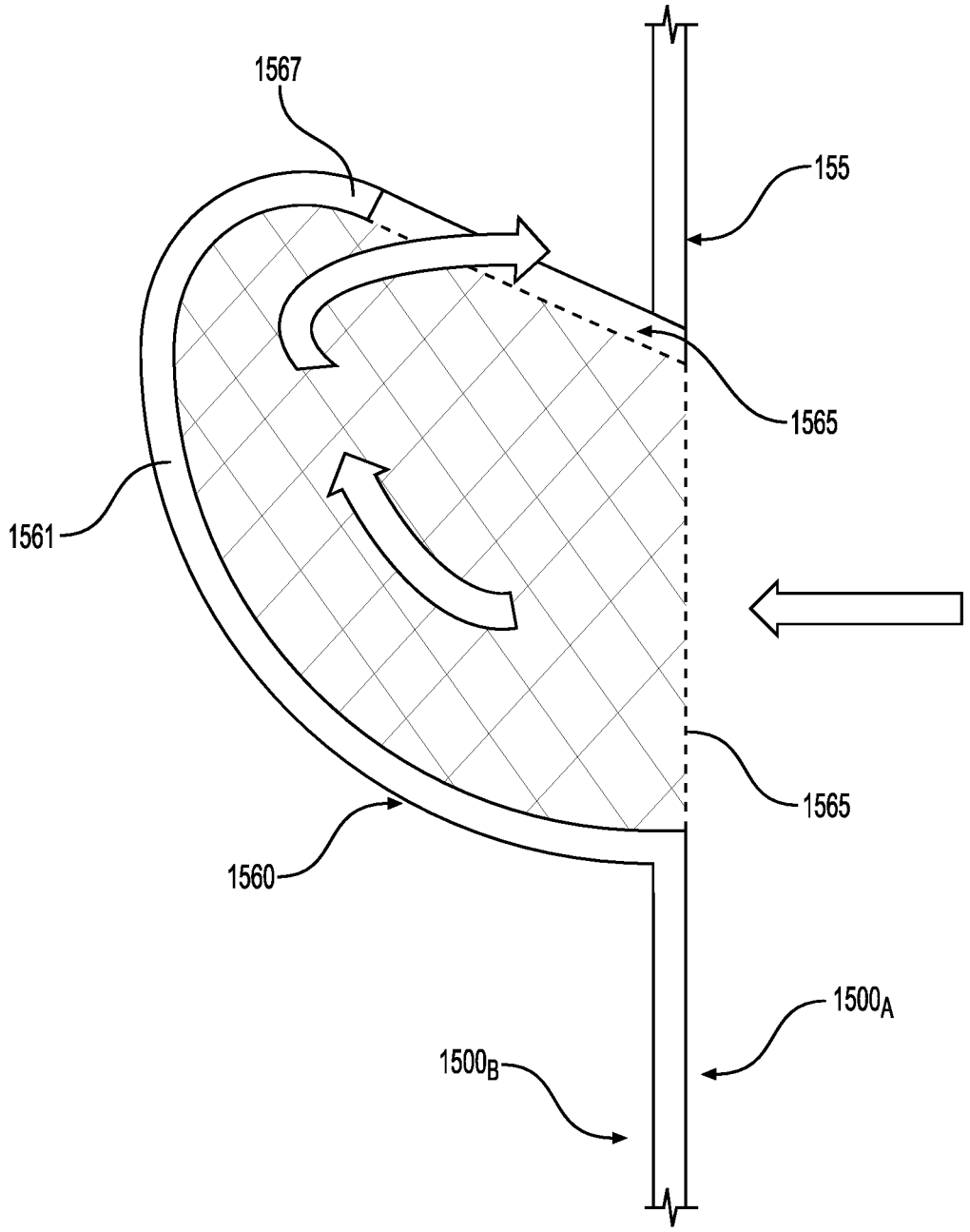
FIG. 7A is a cross-sectional view of a penetrating mesh portion of the mesh panel according to an alternative embodiment.

In another alternative embodiment of the penetrating mesh portions 1560 depicted in FIG. 7A, the side wall 1561 of each penetrating mesh portion 1560 extends, from the inlet end 1565, generally upwardly and in the depth direction of the mesh body 155. As discussed above, the extension of the side wall 1561 in the depth direction increases the surface contact between the incoming air flow and the water retained on the side wall 1561, thereby increasing evaporation of water to cool the ambient air flowing through the mesh panel 150. As can be seen, in this example, the side wall 1561 curves upwardly and defines in part a bottom edge of the corresponding air flow opening 1562. Moreover, in this embodiment, the side wall 1561 curves into itself around the outlet end 1567 to further promote turbulent air flow. Thus, the curved shape of the side wall 1561 deflects the incoming air flow (as denoted by the air flow arrows in FIG. 7A), generating turbulence of the air flow which is beneficial to split water droplets and increase an amount of time that air lingers around the mesh panel 150 and collects water therefrom and thus promotes improved cooling of the incoming air flow.

In some embodiments, one or more of the penetrating mesh portions 1560 may be a mirrored version of the penetrating mesh portion 1560 illustrated on FIG. 7A, such that their respective side wall 1561 extends generally downwardly and in the depth direction of the mesh body 155. Moreover, in some embodiments, a first portion of the mesh body 155 may comprise penetrating mesh portions 1560 having their respective side wall 1561 extending generally upwardly and in the depth direction of the mesh body 155, and a second portion of the mesh body 155 may comprise penetrating mesh portions 1560 having their respective side wall 1561 extending generally downwardly and in the depth direction of the mesh body 155.

Figure 7B:
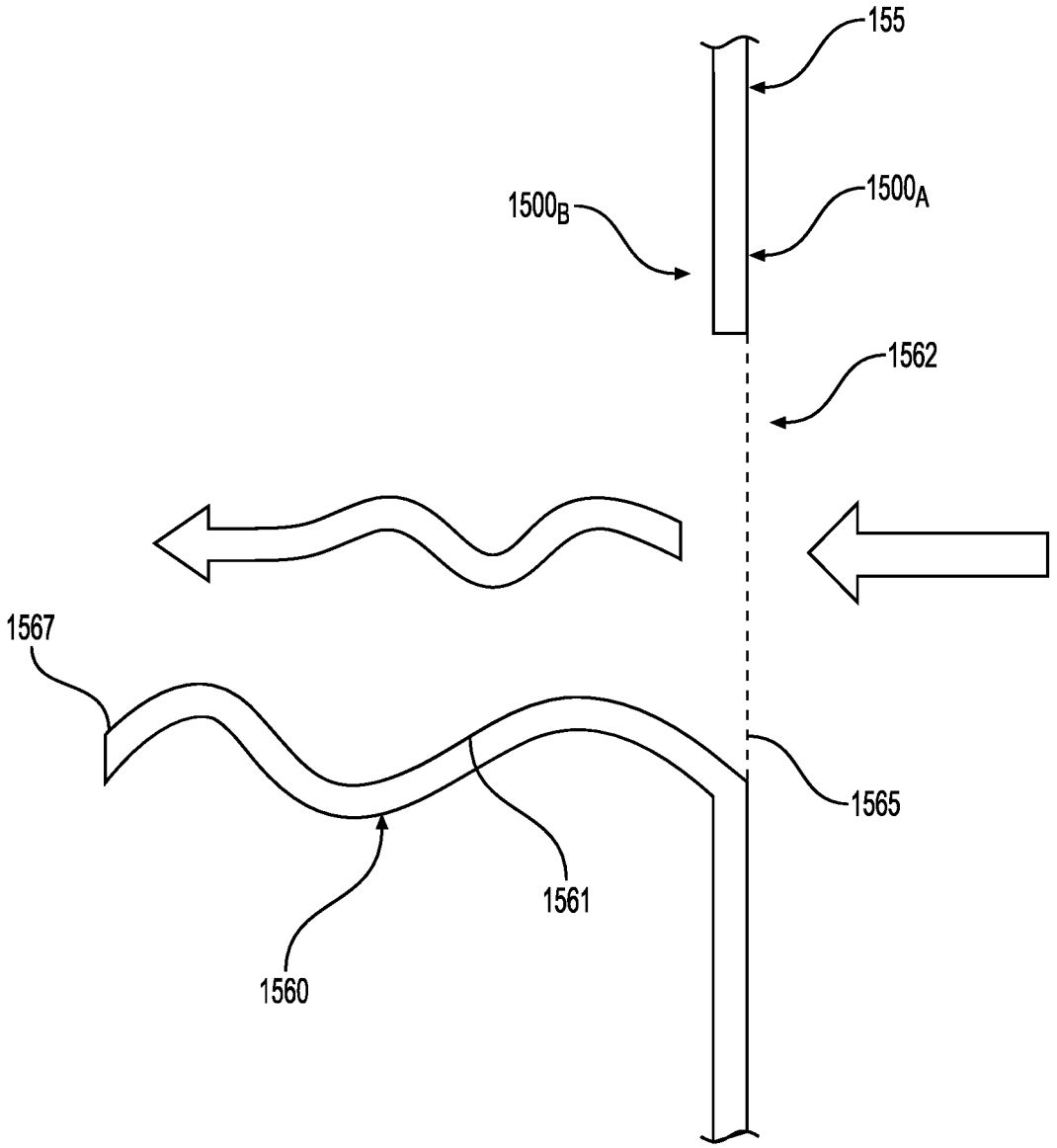
FIG. 7B is a cross-sectional view of a penetrating mesh portion of the mesh panel according to an alternative embodiment.

FIG. 7B shows another alternative embodiment of the penetrating mesh portions 1560. As can be seen, in this alternative embodiment, the side wall 1561 of each penetrating mesh portion 1560 has a wavy configuration and extends generally in the depth direction of the mesh body 155. In particular, the side wall 1561 has alternatingly upwardly and downwardly extending sections. In addition to increasing the surface contact between water on the side wall 1561 and the incoming air flow, the wavy configuration of the side wall 1561 also deflects the incoming air flow (as denoted by the air flow arrows in FIG. 7B), generating turbulence of the air flow which is beneficial to split water droplets and thus promote water evaporation and improved cooling of the incoming air flow.

While the mesh panels 150 have been described above as being generally planar (as depicted in FIG. 1 for example), the mesh panels 150 may be configured differently in other embodiments, while still being provided with any of the penetrating mesh portions 1560 discussed in the above-described embodiments.

Figure 8:
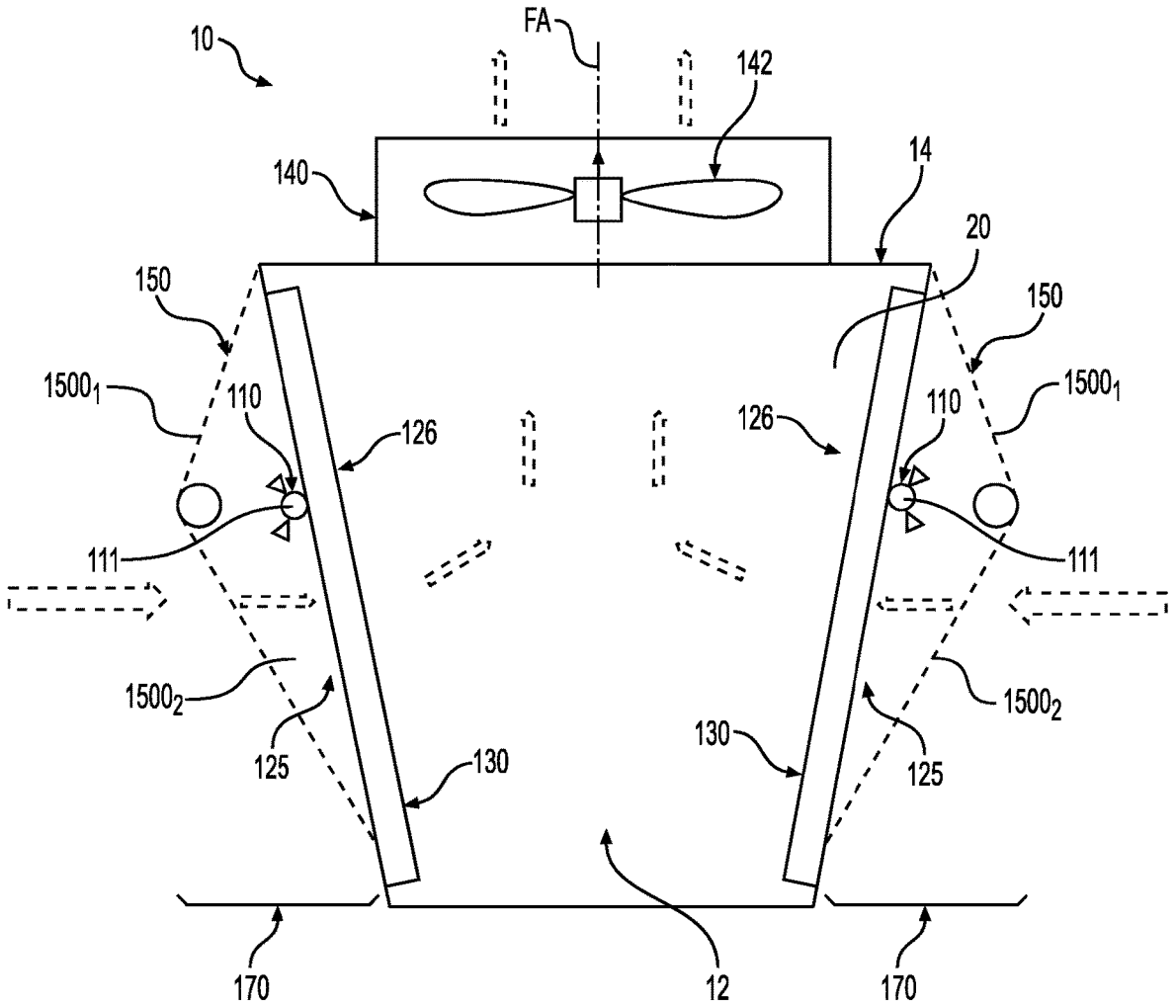
FIG. 8 is a right side elevation view of the dry cooler, with the mesh panel shown in an alternative configuration.

For instance, with reference to FIG. 8, in some embodiments, each mesh panel 150 extends along more than one planar section. Notably, the mesh body 155 of the mesh panel 150 has a first angled portion $\mathbf{1500}_1$ extending from the upper end 1510 and a second angled portion $\mathbf{1500}_2$ extending from the lower end 1512 to the first angled portion 1500*i*. As can be seen, the first and second angled portions $\mathbf{1500}_1$, $\mathbf{1500}_2$ are angled relative to one another. In the embodiment of FIG. 8, each mesh panel 150 is bent around a horizontal axis extending longitudinally (i.e., parallel to the upper and lower edges of the mesh body 155). Additional supports (not shown) are provided to extend a middle portion of each mesh panel 150 outwardly, thereby defining the two angled portions $\mathbf{1500}_1$, $\mathbf{1500}_2$ of the mesh body 155. The angled portions $\mathbf{1500}_1$, $\mathbf{1500}_2$ provide a higher thermal exchange surface between the air and water from the water sprayed on the mesh body 155 as the surface of the mesh panel 150 is increased. Indeed, the mesh panel 150 can receive and retain a higher quantity of water and thereby enables a higher quantity of water to evaporate. The cooling efficiency of the air flowing through the mesh panels 150 is thus increased compared to the planar mesh panel 150. It is contemplated that the mesh panels 150 may comprise a different number of angled portions in alternative embodiments.

Figure 9:
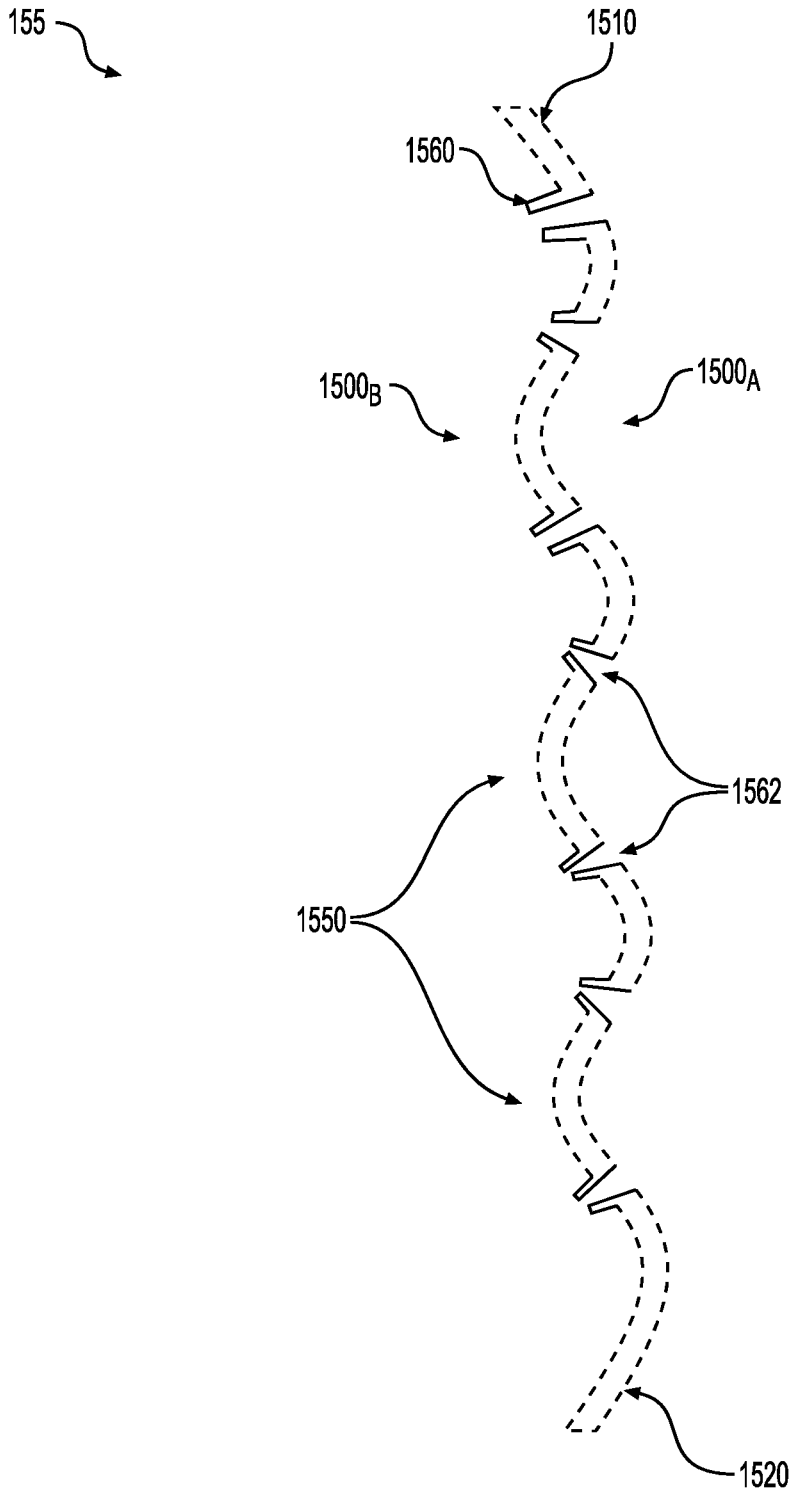
FIG. 9 is a cross-sectional view of the mesh panel, with the mesh panel shown in another alternative configuration.

In other embodiments, with reference to FIG. 9, the mesh body 155 has an undulating configuration such that the mesh body 155 forms a plurality of undulations 1550 offset from another in a height direction of the mesh body 155 (the height direction being normal to the depth direction). A distance between two consecutive undulations 1550, namely a spatial period of the pattern defined by the mesh body 155 may vary. Other periodical or non-periodical shapes may be defined by the mesh body 155 in alternative embodiments. The two angled portions $\mathbf{1500}_1$, $\mathbf{1500}_2$ are not depicted on FIG. 6 but the mesh body 155 may be bent around a horizontal axis that is orthogonal to the depth direction and may thus form the two angled portions $\mathbf{1500}_1$, $\mathbf{1500}_2$.

Figure 10:
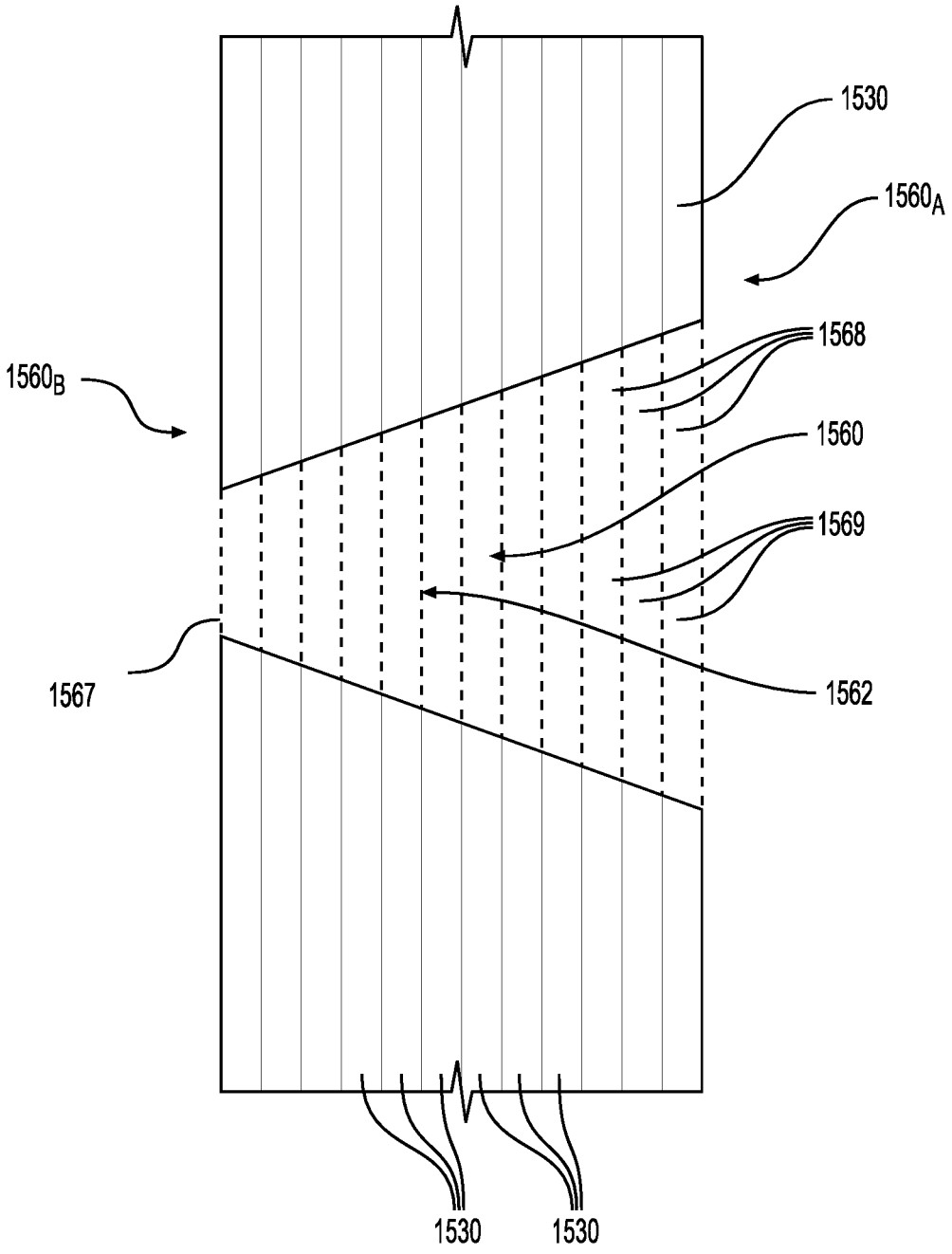
FIG. 10 is a cross-sectional view of part of a mesh panel according to another embodiment in which the mesh body has multiple mesh layers.

Furthermore, in the above-described embodiments, the mesh body 155 has a single mesh layer which defines the penetrating mesh portions 1560. However, with reference to FIG. 10, in an alternative embodiment, the mesh body 155 includes a plurality of mesh layers 1530 stacked with one another in the depth direction to form the mesh body 155. For instance, the multiple mesh layers 1530 can be secured to the mesh panel frame 152 which retains the mesh layers 1530 against one another. Each mesh layer 1530 comprises respective mesh wires 1505 arranged to form a mesh pattern and defining the mesh openings 1520 therebetween. In this alternative, embodiment, the penetrating mesh portions 1560 of the mesh body 155 are collaboratively formed by the various mesh layers 1530. Notably, the peripheral side wall 1561 of each penetrating mesh portion 1560 is formed by respective surfaces of the mesh layers 1530. In particular, in this example of implementation, each mesh layer 1530 defines a plurality of layer air flow openings 1568, each being surrounded by a peripheral opening surface 1569. The air flow openings 1562 defined by the penetrating mesh portions 1560 are formed by aligning the layer air flow openings 1568 with one another. In this example, the mesh body 155 includes between at least 10 mesh layers 1530. The mesh body 155 may comprise fewer or more mesh layers 1530 in other embodiments.

As will be understood from the above description, the mesh panels 150 according to the present technology improve the pre-cooling of air prior to its entry into the interior space 12 of the dry cooler 10. Notably, the penetrating mesh portions 1560 formed in the mesh panels 150 can increase surface contact between air flowing through the mesh panels 150 and water retained by the penetrating mesh portions. Moreover, the shape of the penetrating mesh portions can improve the evaporation ratio of water sprayed onto the mesh panels 150. Therefore, the mesh panels 150 provide a cost-efficient manner to improve the adiabatic cooling of ambient air for heat exchanger systems such as dry coolers.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A mesh panel for a heat exchanger system, the mesh panel comprising:

a mesh body extending from an upper end to a lower end, the mesh body having an inlet side and an outlet side opposite the inlet side, the mesh body comprising a plurality of mesh wires arranged to form a mesh pattern defining a plurality of mesh openings between the mesh wires, the mesh body comprising:

at least one penetrating mesh portion configured to deflect air flowing therethrough, the at least one penetrating mesh portion extending at least partly along a depth direction of the mesh body, the depth direction being normal to a plane extending between the upper and lower ends of the mesh body, the at least one penetrating mesh portion at least partly defining an air flow opening, the air flow opening having greater dimensions than each of the mesh openings, each of the at least one penetrating mesh portion comprising:

an inlet end;

an outlet end distanced from the inlet end along the depth direction, wherein the outlet end defines the air flow opening; and a side wall extending between the inlet end and the outlet end at least partly in the depth direction, wherein the side wall is configured to deflect air flowing through the penetrating mesh portion, wherein the side wall is a peripheral side wall defining a periphery of the at least one penetrating mesh portion, and wherein the peripheral side wall of the at least one penetrating mesh portion converges toward the outlet end.

2. The mesh panel of claim 1, wherein the at least one penetrating mesh portion has a generally truncated conical shape.

3. The mesh panel of claim 1, wherein the air flow opening defined by each of the at least one penetrating mesh portion is circular.

4. The mesh panel of claim 1, wherein the air flow opening defined by each of the at least one penetrating mesh portion is polygonal.

5. The mesh panel of claim 1, wherein:

the at least one penetrating mesh portion defines a first perimeter at the inlet end and a second perimeter at the outlet end; and the first perimeter is greater than the second perimeter.

6. The mesh panel of claim 1, wherein:

the at least one penetrating mesh portion comprises a plurality of penetrating mesh portions; and at least some of the penetrating mesh portions are spaced apart from one another along a height direction of the mesh body, the height direction being normal to the depth direction.

7. The mesh panel of claim 1, wherein the at least one penetrating mesh portion deflects air flowing through the air flow opening to cause turbulence thereof.

8. The mesh panel of claim 1, wherein:

the mesh body comprises a plurality of mesh layers stacked with one another in the depth direction to form the mesh body; and the air flow opening defined at least in part by the at least one penetrating mesh portion is defined in part by each of the mesh layers.

9. The mesh panel of claim 1, wherein:

the mesh body has a first angled portion extending from the upper end and a second angled portion extending from the lower end to the first angled portion, the first and second angled portions being angled relative to one another; and each of the at least one penetrating mesh portion is formed in one of the first angled portion and the second angled portion.

10. The mesh panel of claim 1, wherein the mesh body has an undulating configuration such that the mesh body forms a plurality of undulations offset from another in a height direction of the mesh body, the height direction being normal to the depth direction.

11. A heat exchanger system comprising:

a frame;

at least one heat exchanger panel connected to the frame and configured to exchange heat with air flowing therethrough, the at least one heat exchanger panel having an inlet side and an outlet side, the at least one heat exchanger panel comprising:

a cooling coil for circulating fluid therein; and a plurality of fins in thermal contact with the cooling coil, the fins being spaced from one another for air to flow therebetween and into an interior space of the heat exchanger system;

a fan assembly connected to the frame and comprising at least one fan, the at least one fan being rotatable about a fan rotation axis to pull air into the interior space through the at least one heat exchanger panel and evacuate heated air from the interior space through the fan assembly;

at least one mesh panel disposed on the inlet side of the at least one heat exchanger panel such that rotation of the at least one fan causes ambient air to flow subsequently through the at least one mesh panel, through the heat exchanger panel, and into the interior space, the at least one mesh panel comprising:

a mesh body extending from an upper end to a lower end, the mesh body having an inlet side and an outlet side opposite the inlet side, the mesh body comprising a plurality of mesh wires arranged to form a mesh pattern defining a plurality of mesh openings between the mesh wires, the mesh body comprising at least one penetrating mesh portion configured to deflect air flowing therethrough, the at least one penetrating mesh portion extending at least partly along a depth direction of the mesh body, the depth direction being normal to a plane extending between the upper and lower ends of the mesh body, the at least one penetrating mesh portion at least partly defining an air flow opening, the air flow opening having greater dimensions than each of the mesh openings, each of the at least one penetrating mesh portion comprising:

an inlet end;

an outlet end distanced from the inlet end along the depth direction, wherein the outlet end defines the air flow opening; and a side wall extending between the inlet end and the outlet end at least partly in the depth direction, wherein the side wall is configured to deflect air flowing through the penetrating mesh portion; and a water distribution system operable to spray water on the mesh panel to pre-cool ambient air flowing through the mesh panel.

12. The heat exchanger system of claim 11, wherein the water distribution system comprises a conduit disposed between the at least one heat exchanger panel and the mesh panel, the water distribution system being operable to spray water from the conduit onto the mesh panel.

13. The heat exchanger system of claim 11, wherein the heat exchanger system is a dry cooler.

14. The heat exchanger system of claim 11, wherein the side wall is a peripheral side wall defining a periphery of the at least one penetrating mesh portion, and wherein the peripheral side wall of the at least one penetrating mesh portion converges toward the outlet end.

15. The heat exchanger system of claim 11, wherein:

the at least one penetrating mesh portion comprises a plurality of penetrating mesh portions; and at least some of the penetrating mesh portions are spaced apart from one another along a height direction of the mesh body, the height direction being normal to the depth direction.

16. A mesh panel for a heat exchanger system, the mesh panel comprising:

a mesh body extending from an upper end to a lower end, the mesh body having an inlet side and an outlet side opposite the inlet side, the mesh body comprising a plurality of mesh wires arranged to form a mesh pattern defining a plurality of mesh openings between the mesh wires, the mesh body comprising:

at least one penetrating mesh portion configured to deflect air flowing therethrough, the at least one penetrating mesh portion extending at least partly along a depth direction of the mesh body, the depth direction being normal to a plane extending between the upper and lower ends of the mesh body, the at least one penetrating mesh portion at least partly defining an air flow opening, the air flow opening having greater dimensions than each of the mesh openings, each of the at least one penetrating mesh portion comprising:

an inlet end;

an outlet end distanced from the inlet end along the depth direction, wherein the outlet end defines the air flow opening; and a side wall extending between the inlet end and the outlet end at least partly in the depth direction, wherein the side wall is configured to deflect air flowing through the penetrating mesh portion, wherein the side wall is a peripheral side wall defining a periphery of the at least one penetrating mesh portion, wherein the at least one penetrating mesh portion defines a first perimeter at the inlet end and a second perimeter at the outlet end, and wherein the first perimeter is greater than the second perimeter.

17. The mesh panel of claim 16, wherein the air flow opening defined by each of the at least one penetrating mesh portion is circular or polygonal.

18. The mesh panel of claim 16, wherein the at least one penetrating mesh portion has a generally truncated conical shape.

19. The mesh panel of claim 16, wherein:

the at least one penetrating mesh portion comprises a plurality of penetrating mesh portions; and at least some of the penetrating mesh portions are spaced apart from one another along a height direction of the mesh body, the height direction being normal to the depth direction.

20. The mesh panel of claim 16, wherein:

the mesh body comprises a plurality of mesh layers stacked with one another in the depth direction to form the mesh body; and the air flow opening defined at least in part by the at least one penetrating mesh portion is defined in part by each of the mesh layers.

* * * * *